United States Patent [19]

Bader et al.

[11] 4,126,803

[45] Nov. 21, 1978

[54] X-RAY TUBE AND APPARATUS INCLUDING AN X-RAY TUBE

[75] Inventors: Dietrich Bader; Engelbert Berger; Dieter Ohnemüller; Sieghard Reiprich, all of Berlin, Germany

[73] Assignee: Licentia Patent-Verwaltungs-G.m.b.H., Frankfurt am Main, Germany

[21] Appl. No.: 620,499

[22] Filed: Oct. 7, 1975

[30] Foreign Application Priority Data

Oct. 11, 1974 [DE] Fed. Rep. of Germany ..... 2448497

[51] Int. Cl.[2] ..... H01J 35/011

[52] U.S. Cl. ..... 313/55; 250/421

[58] Field of Search ..... 313/55, 60, 58

[56] References Cited

U.S. PATENT DOCUMENTS

| | | | |
|---|---|---|---|
| 2,228,384 | 1/1941 | Bouwers et al. | 313/55 X |
| 3,397,337 | 8/1968 | Denholm | 313/55 X |
| 3,719,846 | 3/1973 | Berends et al. | 313/60 X |
| 3,911,306 | 10/1975 | Peter | 313/58 |

*Primary Examiner*—Rudolph V. Rolinec
*Assistant Examiner*—Darwin R. Hostetter
*Attorney, Agent, or Firm*—Spencer & Kaye

[57] ABSTRACT

An X-ray tube including a cylindrical vacuum envelope at whose frontal or end surfaces are disposed the high voltage leads for the anode and the cathode. The vacuum envelope comprises a cylindrical metal member with at least one end surface face thereof being closed in a vacuum tight manner by means of an annular ceramic member with one of the high voltage leads, and possibly further leads, passing through the central opening of the annular member in a vacuum tight manner, so that the insulating path between the associated high voltage lead and the metal cylindrical member extends in a predominantly radial direction. Preferably the outer surface of the annular ceramic member forms an angle with a plane perpendicular to the longitudinal axis of the X-ray tube which angle is equal to or less than 45°, and more preferably equal to or less than 30°.

17 Claims, 11 Drawing Figures

X-RAY TUBE AND APPARATUS INCLUDING AN X-RAY TUBE

BACKGROUND OF THE INVENTION

The present invention relates to an improved X-ray tube of the type having a cylindrical, at least partially X-ray transmitting, vacuum envelope which is formed at least partially of metal and with the high voltage leads for the anode and the cathode disposed at the frontal or end surfaces of the envelope.

X-ray tubes for various applications are known to be operated with high direct or alternating voltages applied between the anode and the cathode, and depending on the desired radiation intensity, the voltages applied reach up to several 100kV. In such X-ray tubes, the necessary insulating paths are arranged predominantly in the axial direction.

In order to assure insulation of such X-ray tubes against ground, it is the custom to form so-called hood units which include a metallic jacket in whose cavity the X-ray tube is disposed and surrounded by an insulating medium which may consist of a gas, an oil or another solid substance. For operation with direct voltages these hood units are additionally provided with high voltage outlets through which the high voltage is fed to the X-ray tube by means of high voltage cables.

Depending on the type of tube, the anode may be electrically connected with the metallic jacket portion and may be grounded so that the cathode lies at a potential which is highly negative with respect to the outer wall of the hood, or the metal jacket of the hood portion may be grounded and the anode may have a positive voltage and the cathode a negative voltage compared to ground. These tubes are called single-pole and dual-pole X-ray tubes, respectively.

When X-ray tubes are operated with alternating voltage it is the custom to arrange the required high voltage transformer(s) together with the tube within the hood portion and likewise surround the transformers with an insulating medium.

In such known devices it is considered a drawback that (a) the hood unit of necessity has a substantially larger diameter than the X-ray tube;

(b) the dimensions of the outlets significantly increase the dimensions of the hood unit; and (c) upon a defect in the tube or in the high voltage leads or in the transformers it will generally be necessary to disassemble the entire hood unit which must then be refilled with insulating medium after careful evacuation, and consequently exchange of the defective part can be accomplished only in a service shop.

SUMMARY OF THE INVENTION

It is the object of the present invention to provide a novel X-ray tube which has a simple configuration, permits assembly of more compact X-ray apparatus and possibly permits exchange of defective parts at the place of installation of the X-ray devices.

According to the present invention, the above object is basically achieved in that in an X-ray tube of the type including a sealed cylindrical vacuum envelope and with the high voltage leads for the anode and cathode extending through the end surfaces of the envelope, the envelope includes a metal cylindrical wall member which is sealed in a vacuum tight manner at both ends by respective end members with at least one of the end members being an annular ceramic member whose outer periphery is fastened to the cylindrical member in a vacuum tight manner and through whose central opening passes one of the high voltage leads, and possibly other required leads, in a vacuum tight manner, so that the insulating path between the asociated high voltage lead and the cylrindrical member is predominantly in a radial direction. Preferably the outer surface of the annular ceramic member forms an angle with a plane perpendicular to the longitudinal axis of the tube which is equal to or less than 45°, and in particular equal to or less than 30°.

A significant advantage of the present invention is that the X-ray tube according to the invention makes it possible for the tube to be exchanged, if required, at its place of use. Its simple configuration permits simple and economic manufacture of the tube and makes possible the use of the module principle to the extent that, for example, it is possible to manufacture X-ray tubes which have the same outer dimensions and a majority of identical components but have different properties and fields of application.

The X-ray tube according to the invention can be designed as a single-pole or as a dual-pole tube. The X-ray tube according to the invention can further be installed in such a manner that the cylindrical outer wall of the tube is placed directly at ground potential so that the use of the tube in a hood with an insulating material is no longer necessary. The shape of the insulating outer surface of the ceramic member as provided by the invention assures good high voltage insulation and, due to the disc-shaped design of the insulator, i.e., ceramic member, has the further advantage that it requires very little structural volume, and in particular only very short structural lengths. The electrical stresses which occur predominantly in the radial direction permit, due to the disc-shaped configuration of the insulator, the avoidance of problems encountered with layered dielectrics.

DETAILED DESCRIPTION OF THE PREFERRED EMBODIMENTS

Figure 1:
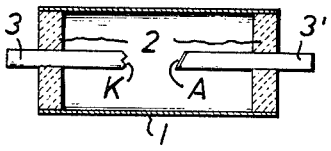
FIGS. 1 through 3 are schematic sectional views of three embodiments of X-ray tubes according to the invention of the dual-pole type in which the anode as well as the cathode are insulated from the metal cylindrical envelope wall and which have a shorter structural length and permit simplified installation of the required connecting parts.

Referring now to the Figures, wherein the same reference numerals are used to designate the same elements, FIG. 1 shows one embodiment of the X-ray tube according to the invention having a vacuum envelope formed by a metal cylindrical wall or jacket member 1 and a pair of annular ceramic insulating discs 2 disposed at the ends of the cylindrical member 1 and forming the respective end or frontal surfaces of the envelope. The annular ceramic discs 2 are connected with the cylindrical metal wall or jacket member 1 in a vacuum tight manner and as mentioned above constitute part of the vacuum envelope of the X-ray tube. The high voltage leads 3' and 3, which in the illustrated embodiment directly support the anode A and the cathode K respectively, pass through the center openings in the respective annular discs 2 in a vacuum tight manner. The vacuum tight connections between the discs 2 and each of the jacket member 1 and leads 3, 3', are preferably effected in a well known manner as metal ceramic solderings. In the embodiment shown in FIG. 1 the ceramic discs 2 are designed as plane parallel annular discs. The outer surfaces of these annular ceramic discs assure safe high voltage insulated connection of further components as will be discussed below.

Figure 2:
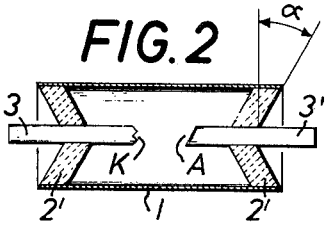
Figure 3:
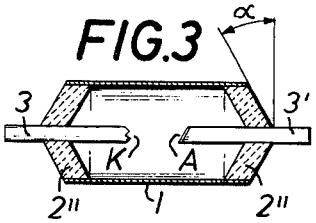

FIGS. 2 and 3 show an X-ray tube according to the invention which differ from that shown in FIG. 1 only as regards the shape of the annular ceramic discs 2. In FIG. 2 instead of being plane parallel discs, the ceramic discs 2' are designed with a frustoconical envelope, with the outer surfaces of these ceramic end discs being concave. In FIG. 3 the discs 2'' likewise have a frustoconical enevelope but the outer surfaces are convex.

According to a significant feature of the invention, the angles $\alpha$ which the outer frontal surfaces of the ceramic discs 2' and 2'' of FIGS. 2 and 3 enclose with a plane perpendicular to the longitudinal axis of the X-ray tube are equal to or less than 45°, and preferably equal to or less than 30°. It has been found that if these given limit angles are observed, insulation for the high voltage is assured with much shorter insulation paths than was present in the prior art high voltage connections.

With the embodiments of the X-ray tube according to the invention shown in FIGS. 1–3, according to a further feature of the invention, the high voltage is connected to the tubes in such a manner that connecting members, which also have a metallic outer jacket or wall portion and contain the high voltage outlets, cables or high voltage transformers or other components embedded in an insulating medium, are pushed onto the high voltage leads 3, 3'. These connecting members are pushed onto the leads 3, 3' in the axial direction and accordingly it is particularly advisable to design the outer surfaces of the annular ceramic discs 2 to have a certain angle since this improves centering of the tube relative to the connecting members.

The connecting members placed onto these high voltage leads 3,3' of the tube are electrically conductively connected with their metal jacket portions to the cylindrical metal member 1 of the tube and are connected to ground. The sides or surfaces of the connecting member adjacent the outer frontal surface of the annular ceramic discs 2 may either be open or closed. If the surface of the connecting members adjacent the surface of the associated ceramic disc, i.e., the mating or connecting surface, is open, the open frontal face of the connecting part is sealed in a gas or liquid tight manner to the frontal surface of the ceramic disc 2 or to the metal jacket member 1 and then the interior of the connecting member is filled with an insulating gas or oil. The connecting members may contain couplings or possibly transformers or directly contain the high voltage cables.

Figure 4:
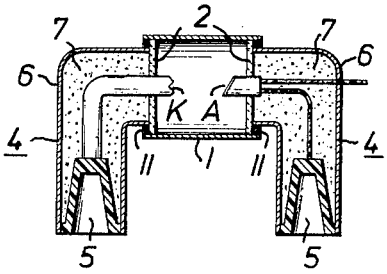
FIGS. 4 through 7 are schematic sectional views showing various devices according to the invention including an X-ray tube according to the embodiment of FIG. 1 which are suitable for use with direct current.

Referring now to FIG. 4 there is shown an apparatus including an X-ray tube as shown in FIG. 1 to which two connecting members 4 as described above are connected by axially pressing same onto the leads 3,3'. Each of the connecting members 4, has a metal outer jacket 6 as well as coupling parts 5 into which high voltage plugs can be inserted. The connecting members 4 are filled with a liquid or gaseous insulating medium 7 which, as a result of the fact that the ends of the jackets 6 adjacent the disc 2 are open, also wets the outer surface of ceramic discs 2. Sealing rings 11 are provided to assure that the insulating medium 7 cannot escape from connecting members 4. The metal jacket 6 is electrically connected with vacuum envelope jacket 1 of the X-ray tube and likewise is connected to ground.

If, instead of the connecting members 4 of FIG. 4 with an open end surface, connecting members with closed end surfaces are used, the frontal or end surface of the connecting members by means of which they are coupled to the outer surface of the annular ceramic discs 2 of the tube are likewise provided with an insulating member whose outer surface corresponds to the shape of the outer surface of insulating ceramic disc 2. For example, in this case the connecting member may then be a metal jacket which is also terminated by an insulating disc. The high voltage carrying components are then disposed, as previously described, in the connecting member and surrounded by an insulating medium. The two mating surfaces, i.e., the outer surface of the ceramic disc of the X-ray tube envelope and the outer surface of the insulating disc of the connecting member, are now pressed together with a plastic insulating medium, e.g., an insulating grease, therebetween. This assures that no air will remain in the gap between the two surfaces of the two superposed insulating discs so that high voltage stability is assured. The same type of seal will also be used if the connecting member contains no liquid or gaseous insulating medium but rather a solid insulating medium. The outer surface of the insulating disc which is to be pressed to the outer surface of the ceramic disc 2 must then be designed to correspond in shape to the outer surface of the ceramic disc 2 of the X-ray tube envelope.

Figure 5:
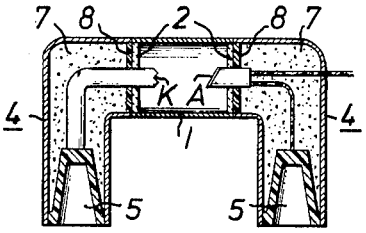

FIG. 5 shows such an apparatus which is similar to that shown in FIG. 4 but in which the ends of the connecting member are closed. As shown, the end surface of the connecting member 4 is terminated by a solid disc 8 of insulating material. As indicated above, an insulating grease (not shown) is provided between the mating surfaces of the associated discs 2 and 8.

Figure 6:
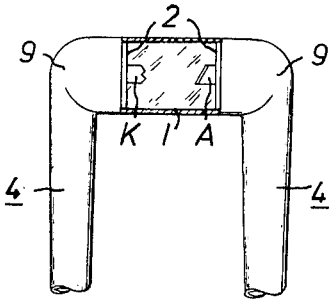

Turning now to FIG. 6 there is shown an embodiment of the invention in which the connecting members 4 are designed as corresponding high voltage cable connectors 9. In this case also the outer surfaces of the insulating annular ceramic discs 2 serve as partners or mating surfaces for the high-voltage connection with the connecting members 4. In the embodiment of FIG. 6 the cable connectors 9 are filled with a solid insulating medium and the opposing surfaces are again connected in a high voltage secure manner through the intermediary of an insulating grease.

Figure 7:
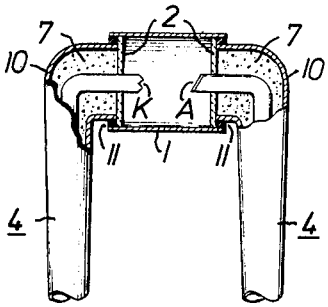

FIG. 7 shows an embodiment in which the connecting members 4 contain the high voltage cable ends. The connecting members, in this case, are provided with a metal jacket 10 filled with a liquid or gaseous insulating medium 7. These connecting members 4 are pressed against the outer frontal surfaces of the ceramic discs 2 so that the liquid or gaseous insulating medium 7 directly contacts the surface of ceramic rings 2, and sealing rings 11 are provided to form a gas or liquid tight connection. This also assures a high voltage secure connection.

Figure 8:
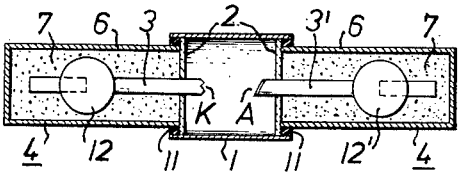
FIGS. 8 and 9 are schematic sectional views of various devices according to the invention including an X-ray tube according to the embodiment of FIG. 1, which are suitable for operation with alternating voltage.

FIG. 8 shows an embodiment which is suited for operation with alternating voltage. The actual X-ray tube with parts 1, 2, 3, K and A is again the same as shown in FIG. 1. In this embodiment, the connecting members 4 are housings including a metallic wall portion 6 which is filled with a liquid or gaseous insulating medium 7 and in which the two high voltage transformers 12 and 12' for cathode and anode, respectively, are disposed. In this embodiment, as in the embodiments of FIGS. 4 and 7, the insulating medium 7 again directly wets the outer surfaces of the ceramic discs 2.

Figure 9:
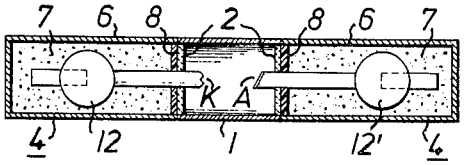

FIG. 9 shows an apparatus similar to that of FIG. 8 which differs only in that the connecting members 4 which contain the high voltage transformers 12 and 12' are also closed at their frontal faces so that they form a closed container which contains the liquid or gaseous insulating medium 7. Preferably each of these connecting members will comprise a metal housing 6 which is sealed at its one frontal face by an insulating disc 8 in a gas or liquid tight manner. The outer surface of this insulating disc 8 is adapted to the shape of the outer surfaces of the ceramic discs 2 of the X-ray tube. The two congruent insulating surfaces 2 and 8 are pressed together through the intermediary of an insulating grease so that high voltage insulation is assured.

Although each of the above embodiments of the invention possesses the advantages of simplicity of construction and decreased size, the embodiments of FIGS. 5, 6 and 9 possess the additional advantage that if the X-ray tube included in an apparatus becomes defective during use, the connecting members 4 can be separated from the tube right at the point of use and the X-ray tube can be exchanged.

It should be noted that although each of FIGS. 1–3 show an X-ray tube according to the invention which is of the dual-pole type, and hence has two identically designed annular discs 2, one at each end of the envelope, such is not required if a single-pole tube is desired. In such case an annular ceramic disc is required for only one end or frontal surface of the X-ray tube envelope and the other end surface may be formed in any desired manner.

Figure 10:
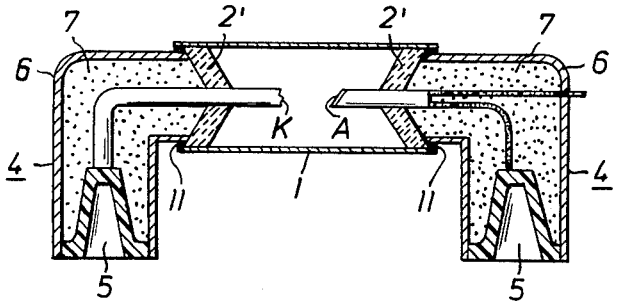
FIGS. 10 and 11 are schematic sectional views showing devices according to the invention including an X-ray tube according to the embodiments of FIGS. 2 and 3 respectively combined with connecting members as shown in FIG. 4 and suitable for use with direct current.

FIG. 10 is a schematic sectional view of a device including an X-ray tube as shown in FIG. 2 to which two connecting members 4 as shown in FIG. 4 are connected in the manner as described in connection with FIG. 4.

Figure 11:
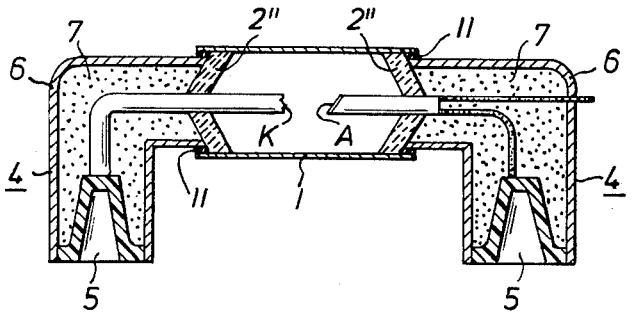

FIG. 11 shows a corresponding combination of a X-ray tube as shown in FIG. 3 with the connecting members 4 as shown in FIG. 4.

It is evident that in principle all connecting members 4 as shown in FIGS. 5 through 9 can be combined with the X-ray tubes of FIGS. 2 and 3.

It will be understood that the above description of the present invention is susceptible to various modifications, changes and adaptations, and the same are intended to be comprehended within the meaning and range of equivalents of the appended claims.

What is claimed is:

1. In an X-ray tube including a closed vacuum envelope, an anode and a cathode within said vacuum envelope and high voltage leads for said anode and said cathode disposed at and extending through the respective end surfaces of said envelope; the improvement wherein said envelope comprises a metal cylindrical wall member and a pair of end members fastened to said wall member with each of said end members having an outer surface which forms a respective one of said end surfaces of said envelope, at least one of said members being an annular ceramic member whose outer periphery is fastened to said cylindrical wall member in a vacuum tight manner and through whose central opening pass one of said high voltage leads in a vacuum tight manner, so that the insulating path between the associated high voltage lead and said metal wall member extends in a predominantly radial direction, and said outer surface of said annular ceramic member forms an angle equal to or less than 45° with a plane perpendicular to the longitudinal axis of said X-ray tube.

2. An X-ray tube as defined in claim 1 wherein said outer surface of said annular ceramic member forms an angle equal to or less than 30° with a plane perpendicular to the longitudinal axis of said X-ray tube.

3. An X-ray tube as defined in claim 1 wherein both of said end members are identical annular ceramic members.

4. An X-ray tube as defined in claim wherein said annular ceramic member has a planar outer surface.

5. An X-ray tube as defined in claim 1 wherein said outer surface of said annular ceramic member is concave.

6. An X-ray tube as defined in claim 5 wherein said outer surface of said annular ceramic member is frustoconical.

7. An X-ray tube as defined in claim 1 wherein said outer surface of said annular ceramic member is convex.

8. An X-ray tube as defined in claim 7 wherein said outer surface of said annular ceramic member is frustoconical.

9. An X-ray tube as defined in claim 1 wherein the high voltage lead passed through said opening in said annular ceramic member is the support for the associated cathode or anode of said X-ray tube.

10. An X-ray tube as defined in claim 1 wherein the said outer surface of said annular ceramic member constitutes a mating surface for a releasable high voltage connection; and further comprising connecting means for providing an axial releasable electrical connection with the said high voltage lead passing through said at least one of said end members.

11. Apparatus as defined in claim 10 wherein said connecting means includes a coupling member for a high voltage plug for providing electrical voltage.

12. Apparatus as defined in claim 10 wherein said connecting means comprises a high voltage connector permanently connected to the end of a high voltage cable.

13. Apparatus as defined in claim 10 wherein said connecting means is pushed onto said high voltage lead and includes a jacket filled with an insulating medium and containing electrical circuit components which are connected to said high voltage lead when said connecting means is connected to said X-ray tube.

14. Apparatus as defined in claim 13 wherein said jacket of said connecting means is a metal jacket which is in electrical contact with said metal cylindrical wall member of the tube envelope.

15. Apparatus as defined in claim 13 wherein: said connecting means comprises a closed container which is filled with a gaseous or liquid insulating medium and is closed at the end surface thereof which abuts said annular ceramic member by means of an insulating disc whose outer surface is adapted to said outer surface of said annular ceramic disc; and a deformable insulating medium introduced between the adjacent said outer surfaces of said insulating disc and said ceramic member.

16. Apparatus as defined in claim 13 wherein: said connecting means comprises a container which is open at the one end thereof facing said annular ceramic member, and means for fastening said connecting means to said tube so that the outer surface of said annular ceramic member forms a seal for the open end of said container; and a liquid or gaseous insulating material filling said container.

17. Apparatus as defined in claim 13 wherein: said envelope of said X-ray tube is provided with one of said annular ceramic members at each of its two end surfaces; and a respective one of said connecting means is releasably fastened to the respective high voltage lead at each of said end surfaces of said tube.

* * * * *